US009382826B1

(12) United States Patent
Fletcher et al.

(10) Patent No.: US 9,382,826 B1
(45) Date of Patent: Jul. 5, 2016

(54) NOISE ATTENUATING MEMBER FOR NOISE ATTENUATING UNITS IN ENGINES

(71) Applicants: David E. Fletcher, Flint, MI (US); Brian M. Graichen, Leonard, MI (US); Denis Vashuk, Saint Clair Shores, MI (US); Rex Bravo, Detroit, MI (US)

(72) Inventors: David E. Fletcher, Flint, MI (US); Brian M. Graichen, Leonard, MI (US); Denis Vashuk, Saint Clair Shores, MI (US); Rex Bravo, Detroit, MI (US)

(73) Assignee: DAYCO IP HOLDINGS, LLC, Troy, MI (US)

( * ) Notice: Subject to any disclaimer, the term of this patent is extended or adjusted under 35 U.S.C. 154(b) by 0 days.

(21) Appl. No.: 14/593,361

(22) Filed: Jan. 9, 2015

(51) Int. Cl.
*F01N 1/24* (2006.01)
*F01N 13/18* (2010.01)

(52) U.S. Cl.
CPC . *F01N 1/24* (2013.01); *F01N 13/18* (2013.01)

(58) Field of Classification Search
CPC ..... F01N 1/24
USPC ..... 181/252, 256, 212, 230, 248
See application file for complete search history.

(56) References Cited

U.S. PATENT DOCUMENTS

| | | | | |
|---|---|---|---|---|
| 2,037,884 | A | | 4/1936 | Day |
| 2,626,009 | A | | 1/1953 | Sebok et al. |
| 2,954,091 | A | | 9/1960 | McMichael |
| 3,430,437 | A | | 3/1969 | Saussele et al. |
| 3,581,850 | A | | 6/1971 | Jaitl |
| 3,614,859 | A | | 10/1971 | Clark |
| 3,826,281 | A | | 7/1974 | Clark |
| 3,842,932 | A | | 10/1974 | Gibel |
| 4,184,565 | A | * | 1/1980 | Price et al. ..... 181/252 |
| 4,408,679 | A | * | 10/1983 | Littrell ..... 181/243 |
| 4,424,883 | A | | 1/1984 | Musiani |
| 4,938,309 | A | | 7/1990 | Emdy |
| 4,951,708 | A | | 8/1990 | Miller |
| 5,326,942 | A | | 7/1994 | Schmid |
| 5,670,756 | A | * | 9/1997 | Ohtaka et al. ..... 181/256 |
| 5,783,780 | A | * | 7/1998 | Watanabe et al. ..... 181/229 |
| 5,801,342 | A | * | 9/1998 | Hultberg et al. ..... 181/224 |
| RE37,090 | E | | 3/2001 | Kloosterman et al. |
| 7,029,103 | B2 | | 4/2006 | Iida |

(Continued)

FOREIGN PATENT DOCUMENTS

| | | |
|---|---|---|
| JP | 07-117010 | 12/1995 |
| WO | 01/86152 | 11/2001 |

OTHER PUBLICATIONS

PCT, International Search Report and Written Opinion, International Application No. PCT/US2014/059672 (Jan. 9, 2015).

(Continued)

*Primary Examiner* — Forrest M Phillips
(74) *Attorney, Agent, or Firm* — Thompson Hine LLP

(57) ABSTRACT

Noise attenuating members for use in noise attenuating units for engine systems are disclosed that include a core, having an interior surface defining a hollow inner cavity and a plurality of radial openings, and a porous material disposed about an exterior surface of the core. The porous material may be a strip which is engaged with the exterior of the core and wrapped around the core to form a plurality of layers of porous material. A noise attenuating unit is disclosed to include a housing, having an internal cavity, first port, and second port, and an attenuating member disposed within the internal cavity. A method of making a noise attenuating member is disclosed that includes providing a core having an hollow cavity and radial openings, providing a strip of porous material, and wrapping the strip of porous material about the core to form one or more layers.

21 Claims, 8 Drawing Sheets

(56) References Cited

U.S. PATENT DOCUMENTS

| | | | | |
|---|---|---|---|---|
| 2001/0015302 | A1* | 8/2001 | Lundgren | 181/252 |
| 2002/0027041 | A1 | 3/2002 | Czabala et al. | |
| 2005/0045417 | A1 | 3/2005 | Ni | |
| 2005/0045419 | A1 | 3/2005 | Choi et al. | |
| 2005/0121084 | A1 | 6/2005 | Andersson | |
| 2006/0016477 | A1 | 1/2006 | Zaparackas | |
| 2007/0292816 | A1 | 12/2007 | Miller | |
| 2008/0145238 | A1 | 6/2008 | Shibayama et al. | |
| 2011/0024228 | A1* | 2/2011 | Murakami et al. | 181/249 |
| 2011/0186151 | A1 | 8/2011 | Sparazynski | |
| 2012/0024249 | A1 | 2/2012 | Fuhrmann et al. | |
| 2013/0139911 | A1 | 6/2013 | Wilson et al. | |
| 2013/0213510 | A1 | 8/2013 | Burnham et al. | |
| 2014/0069067 | A1* | 3/2014 | Latham et al. | 55/486 |
| 2015/0159528 | A1* | 6/2015 | Hampton et al. | 181/252 |

OTHER PUBLICATIONS

PCT, International Search Report and Written Opinion, International Application No. PCT/US2014/069279 (Feb. 26, 2015).

English translation of JP 07-117010, accessed Nov. 9, 2015, <https://www4.j-platpat.inpit.go.jp/cgi-bin/tran_web_cgi_ejje?u=http://www4.j-platpat.inpit.go.jp/eng/translation/201511100304293322079174 6924010100932AF2D1BD4629B19B03A22964BC2FC8>.

PCT, International Search Report and Written Opinion, Patent Application No. PCT/US2016/012033 (Feb. 26, 2016).

* cited by examiner

NOISE ATTENUATING MEMBER FOR NOISE ATTENUATING UNITS IN ENGINES

TECHNICAL FIELD

This application relates to noise attenuation in engine systems such as internal combustion engines, more particularly to the inclusion of a noise attenuating member in a housing configured for insertion in a fluid flow path of an engine.

BACKGROUND

Engines, for example vehicle engines, often include aspirators and/or check valves. Typically, the aspirators are used to generate a vacuum that is lower than engine manifold vacuum by inducing some of the engine air to travel through a venturi. The aspirators may include check valves therein or the system may include separate check valves. When the check valves are separate they are typically included downstream between the source of vacuum and the device using the vacuum.

During most operating conditions of an aspirator or check valve the flow is classified as turbulent. This means that in addition to the bulk motion of the air there are eddies superimposed. These eddies are well known in the field of fluid mechanics. Depending on the operating conditions the number, physical size, and location of these eddies is continuously varying. One result of these eddies being present on a transient basis is that they generate pressure waves in the fluid. These pressure waves are generated over a range of frequencies and magnitudes. When these pressure waves travel through the connecting holes to the devices using this vacuum, different natural frequencies can become excited. These natural frequencies are oscillations of either the air or the surrounding structure. If these natural frequencies are in the audible range and of sufficient magnitude then the turbulence generated noise can become heard, either under the hood, and or in the passenger compartment. Such noise is undesirable and new apparatus are needed to eliminate or reduce the noise resulting from the turbulent air flow.

SUMMARY

In one aspect, a noise attenuating member is disclosed that includes a core defining a hollow cavity for fluid flow therethrough and a porous material disposed about an exterior of the core. The core defines a plurality of radial openings. Fluid flow through the hollow cavity and the radial openings passes through the porous material, which dissipates turbulent eddies in the fluid flow to attenuate noise caused by the fluid flow.

In another aspect, the porous material includes a plurality of layers of the porous material disposed about the core. In one embodiment, the plurality of layers of porous material includes a continuous strip of porous material wound about the exterior of the core. In another embodiment, the continuous strip of porous material has a first end folded over onto itself for engagement with the exterior of the core.

In another aspect, the core has a plurality of radial openings that are larger than a pore size of the porous material. In another aspect, the core is generally a hollow cylindrical grid. In another aspect, the core includes a plurality of protrusions extending outward from the exterior of the core. In one embodiment, each of the protrusions includes one or more features that retain the porous material against the exterior of the core.

In another aspect, the porous material includes one or more of metal, ceramic, carbon fiber, plastic, and glass. The porous material includes one or more of a wire, a wool, a matrix of woven particles, a matrix of matted particles, a matrix of sintered particles, a woven fabric, a matted fabric, a sponge, a mesh, or combinations thereof. In one aspect, the porous material is metal and is one or more of a metal wire mesh, a metal wire wool, and a metal wire felt.

In another aspect, a noise attenuating unit connectable to become part of a fluid flow path includes a housing defining an internal cavity and having a first port and a second port, which are both connectable to a fluid flow path and in fluid communication with one another through the internal cavity. The noise attenuating unit also includes an attenuating member seated in the internal cavity of the housing within the flow of the fluid communication between the first port and the second port. The fluid communication between the first port and the second port includes fluid flow through the attenuating member. The attenuating member includes a core defining a hollow cavity for fluid flow therethrough and defining a plurality of radial openings. The attenuating member also includes a porous material disposed about an exterior of the core such that fluid flow through the hollow cavity and the radial openings passes through the porous material.

In another aspect, the noise attenuating unit includes a housing that is a two-part housing having a first housing portion and a second housing portion. In another aspect, the fluid flow path from the first port to the second port travels axially through the attenuating member. In another aspect, the fluid flow path from the first port to the second port travels through the attenuating member from the hollow cavity radially outward through the porous material. In another aspect, the housing of the noise attenuating unit is integrated with a Venturi apparatus for generating vacuum.

In another aspect, a method for making a noise attenuating member is disclosed to include providing a core defining a hollow cavity for fluid flow therethrough and defining a plurality of radial openings; providing a strip of porous material, the strip having a first end and a second end; and wrapping the strip of porous material about the core, beginning from the first end to form one or more layers of porous material thereabout. In another aspect of the method, the core has a plurality of protrusions extending outward from the exterior thereof, and wrapping the porous material about the core includes engaging the porous material with the protrusions to retain the porous material against the core. In another aspect, the method includes folding the first end of the strip of porous material over onto itself before wrapping the strip of porous material about the core. In another aspect, the method includes adjusting a tension applied to the strip of porous material during wrapping/winding to change the density of the one or more layers of porous material wrapped about the core.

DETAILED DESCRIPTION

Figure 1:
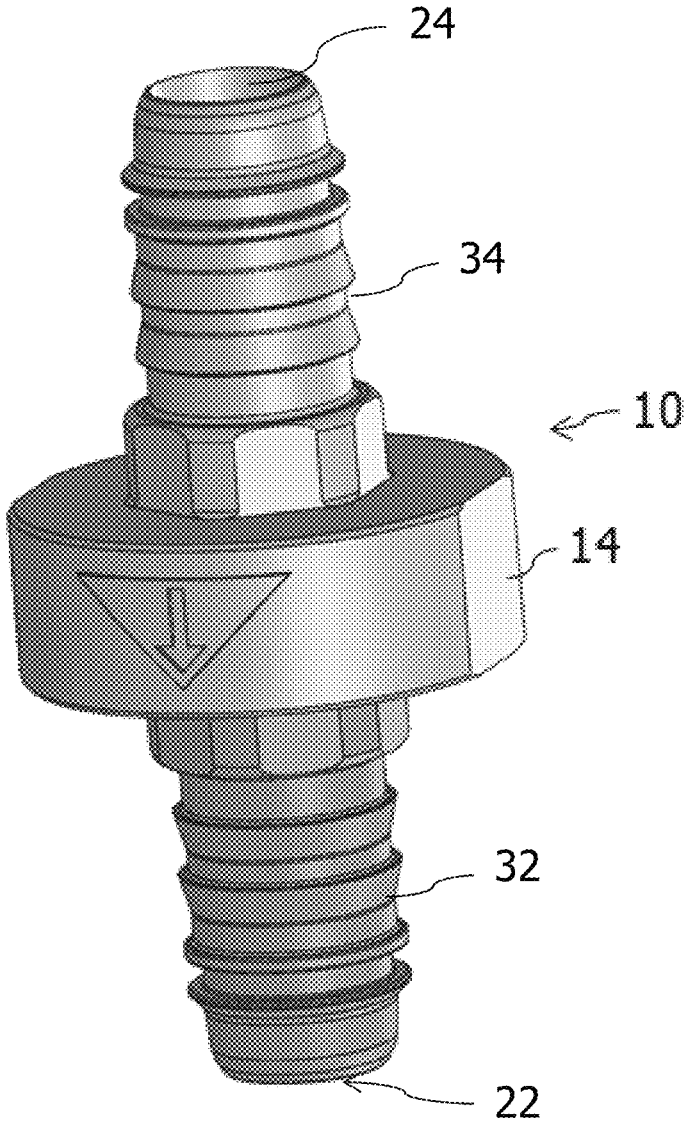
FIG. 1 is a front perspective view of a noise attenuation unit connectable to become part of a fluid flow path.

The following detailed description will illustrate the general principles of the invention, examples of which are additionally illustrated in the accompanying drawings. In the drawings, like reference numbers indicate identical or functionally similar elements.

As used herein "fluid" means any liquid, suspension, colloid, gas, plasma, or combinations thereof.

As used herein "radial" means in a direction generally outward from the central portion of an object and does not imply any particular shape, i.e., the shape is not limited to circular, cylindrical, or spherical.

FIG. 1 is front perspective view of a noise attenuating unit, generally identified by reference number 10, for use in an engine, for example, in a vehicle's engine. The engine may be an internal combustion engine, and the vehicle and or engine may include a device requiring a vacuum. Check valves and or aspirators are often connected to an internal combustion engine before the engine throttle and after the engine throttle. The engine and all its components and/or subsystems are not shown in the figures and it is understood that the engine components and/or subsystems may include any components common to an internal combustion engine. The brake boost system is one example of a subsystem that can be connected to an aspirator and/or check valves. In another embodiment, any one of a fuel vapor purge systems, exhaust gas recirculation system, a crankcase ventilation system and/or a vacuum amplifier may be connected to an aspirator and/or check valve. The fluid flow within the aspirator and/or check valves, in particular when a Venturi portion is included, is generally classified as turbulent. This means that in addition to the bulk motion of the fluid flow, such as air or exhaust gases, there are pressure waves traveling through the assembly and different natural frequencies can become excited thereby resulting in turbulence generated noise. The noise attenuation unit 10 disclosed herein attenuates such turbulence generated noise.

Figure 2:
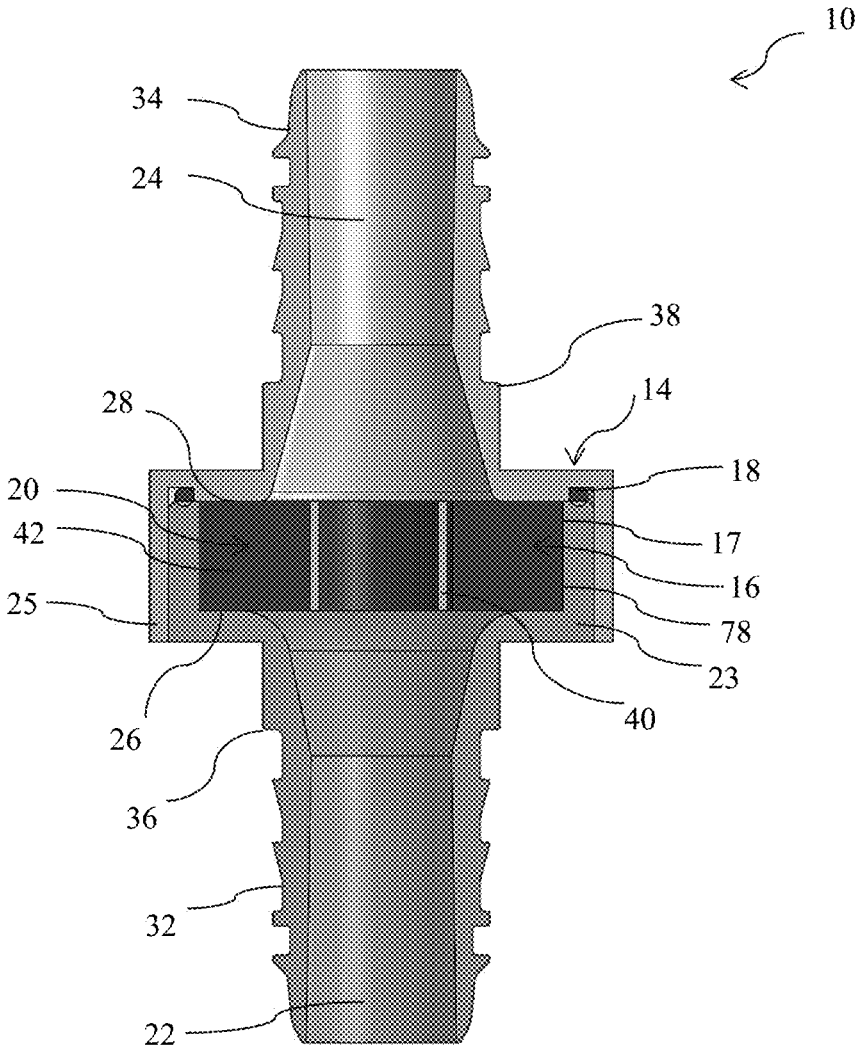
FIG. 2 is a longitudinal, cross-sectional view of the noise attenuation unit of FIG. 1.

Referring to FIGS. 1 and 2, the noise attenuation unit 10 may be disposed in, and thereby becomes part of, any fluid flow path(s) within an engine in need of noise attenuation, and is typically positioned in the flow path downstream of the source of the noise. The noise attenuating unit 10 includes a housing 14 defining an internal cavity 16 enclosing a noise attenuating member 20 therein. The noise attenuating member 20 typically fits securely, at least axially, within the internal cavity 16 sandwiched between a first seat 26 and a second seat 28. As illustrated in FIG. 2, the noise attenuating member 20 has a generally close fit with the interior side wall 17 of the cavity 16, but such a construction is not required. In another embodiment (not shown), there may be a gap defined between the interior side wall 17 of the cavity 16 and an outermost radial surface 78 of the noise attenuating member 20 defined by the porous material 42. The housing defines a first port 22 in fluid communication with the internal cavity 16 and a second port 24 in fluid communication with the internal cavity 16. The exterior surfaces of the housing 14 that define the first and second ports 22, 24 both include fitting features 32, 34 for connecting the noise attenuating unit 10 into a fluid flow path of the engine. For example, in one embodiment both fitting features 32, 34 are insertable into a hose or conduit and the fitting features provide a secure fluid-tight connection thereto.

The housing 14, as shown in FIG. 2, may be a multiple piece housing with a plurality of pieces connected together with a fluid-tight seal. The multiple pieces may include a first housing portion 36 that includes the first port 22 and a male end 23 and a second housing portion 38 that includes the second port 24 and a female end 25. The male end 23 is received in the female end 25 with a sealing member 18 therebetween to provide a fluid-tight seal between the portions 36, 38. In other embodiments, the first housing portion 36 and the second housing portion 38 have a container and cap-type construction.

In the embodiment of FIG. 2, the first port 22 and the second port 24 are positioned opposite one another to define a generally linear flow path through the noise attenuation unit 10, but is not limited to this configuration. In another embodiment, the first and second ports 22, 24 may be positioned relative to one another at an angle of less than 180 degrees. In one embodiment, the second port 24 may be positioned generally 90 degrees relative to the first port 22 such that the fluid flow passes through the noise attenuating member 20 from an inner cavity of a core of the noise attenuating member 20 radially outward through the porous material disposed about the core of the noise attenuating member 20.

Referring again to FIG. 2, the noise attenuating member 20 is dimensioned for a tight fit within the housing thereby the fluid flow through the internal cavity 16 is only available through the noise attenuating member 20 itself and any bores it may include. The noise attenuating member 20 is porous such that fluid flow through the unit 10 is restricted the least amount possible, but sound (turbulence generated noise) is attenuated. Additional examples of noise attenuating units having noise attenuating members can be found in co-pending U.S. patent application Ser. No. 14/565,075, filed Dec. 9, 2014, which is incorporated herein by reference in its entirety. The noise attenuating member of the present disclosure may also be incorporated directly into a check valve assembly or vacuum producing assembly. Examples of check valve and vacuum producing assemblies that can include a noise attenuating member are included in co-pending U.S. patent application Ser. No. 14/509,612, filed Oct. 8, 2014, which is incorporated herein by reference in its entirety.

Figure 3:
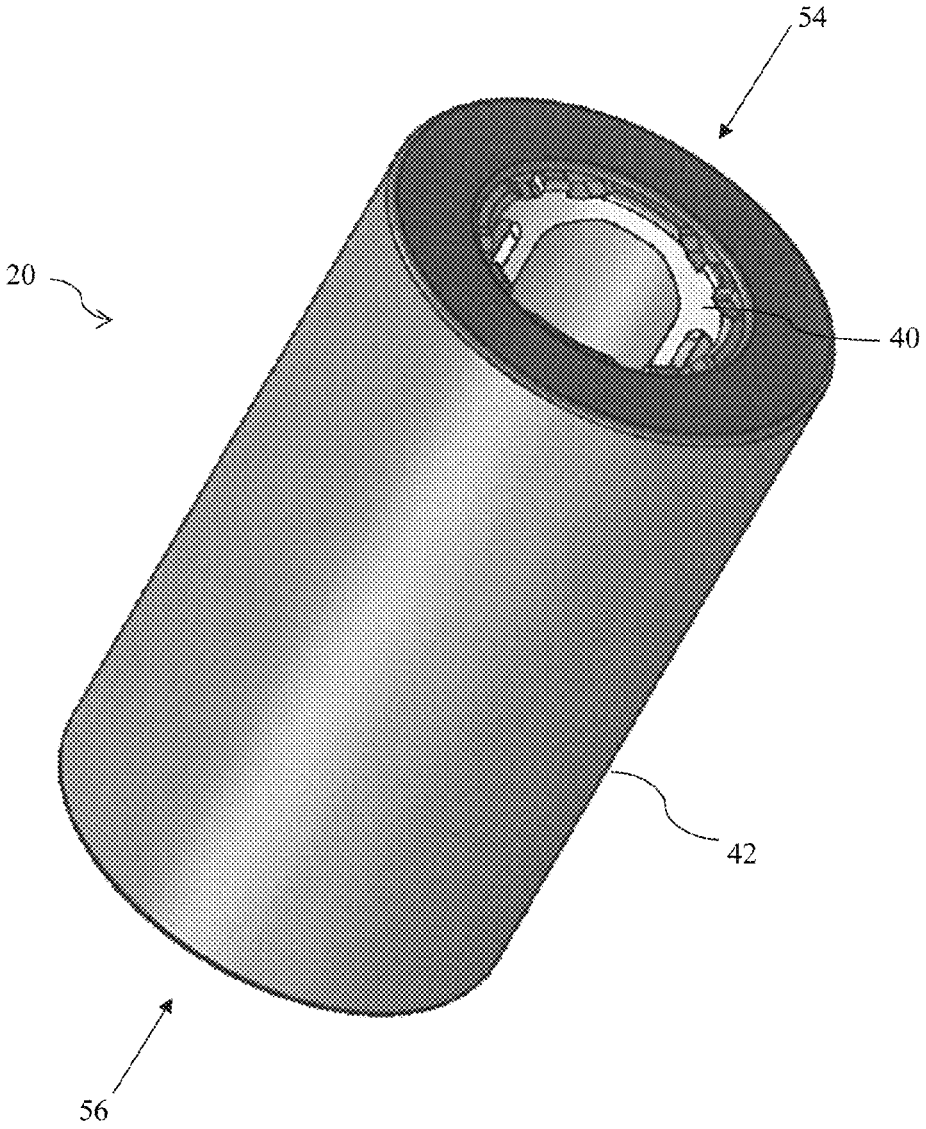
FIG. 3 is a front, perspective view of one embodiment of a noise attenuating member for use in the noise attenuation unit of FIGS. 1-2.
Figure 4:
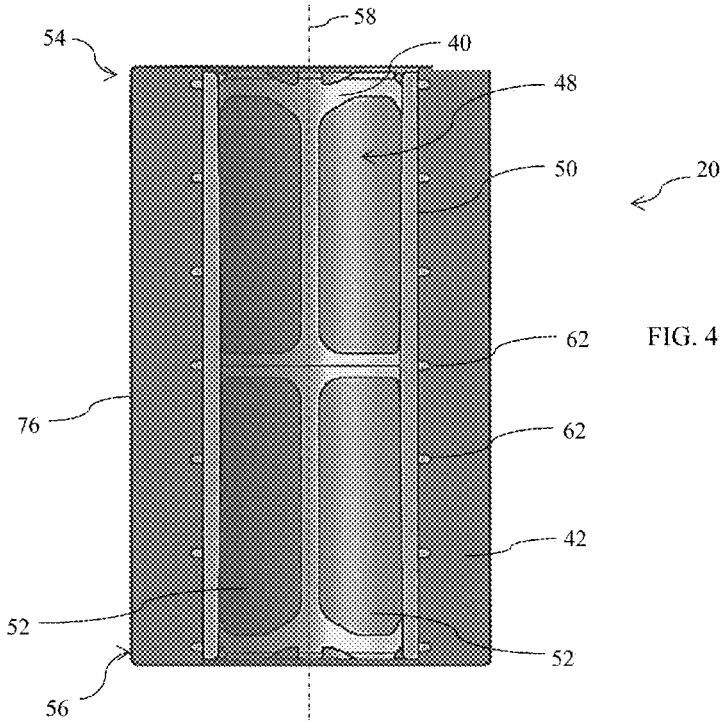
FIG. 4 is a longitudinal, cross-sectional view of the noise attenuating member of FIG. 3.
Figure 5:
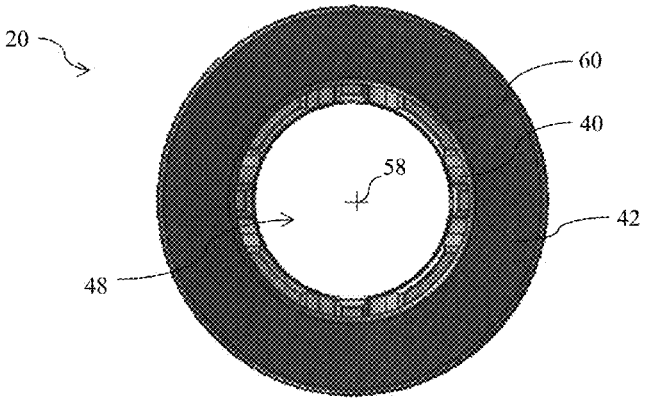
FIG. 5 is top plan view of the noise attenuating member of FIG. 3.

Referring now to FIGS. 3-5, the noise attenuating member 20 includes a core 40 and a porous material 42 disposed about the core 40. In the embodiment shown in FIGS. 3-5, the core 40 is hollow and includes an inner surface 46 defining an inner hollow cavity 48, and an exterior surface 50 facing outward from the core 40. The core 40 has a plurality of radial openings 52 to allow for fluid to flow radially outward from the inner cavity 48 of the core 40, through the radial openings 52, and into and through the porous material 42 disposed about the exterior surface 50 of the core 40. The porous material 42 includes a plurality of pores (not shown) to allow fluid to pass into and through the porous material 42. The noise attenuating member 20 may have a first end 54 and a second end 56, relative to an axial direction of the noise attenuating member 20. For fluid flow directed parallel to a center axis 58 of the noise attenuating member 20, the fluid flow may be in a direction from the first end 54 to the second end 56 or in a direction from the second end 56 to the first end 54. For radial fluid flow through the noise attenuating member 20, the fluid flow may flow into the inner cavity 48 from either or both of the first end 54 and second end 56 and then flow radially outward through the radial openings 52 and into/through the porous material 42. In one embodiment (not shown), the core 40 may be solid and may have the porous material 42 disposed about the exterior surface 50 of the core 40 such that fluid flow through the noise attenuating member 20 parallel to a center axis 58 of the noise attenuating member 20 is all directed through the porous material.

Figure 6:
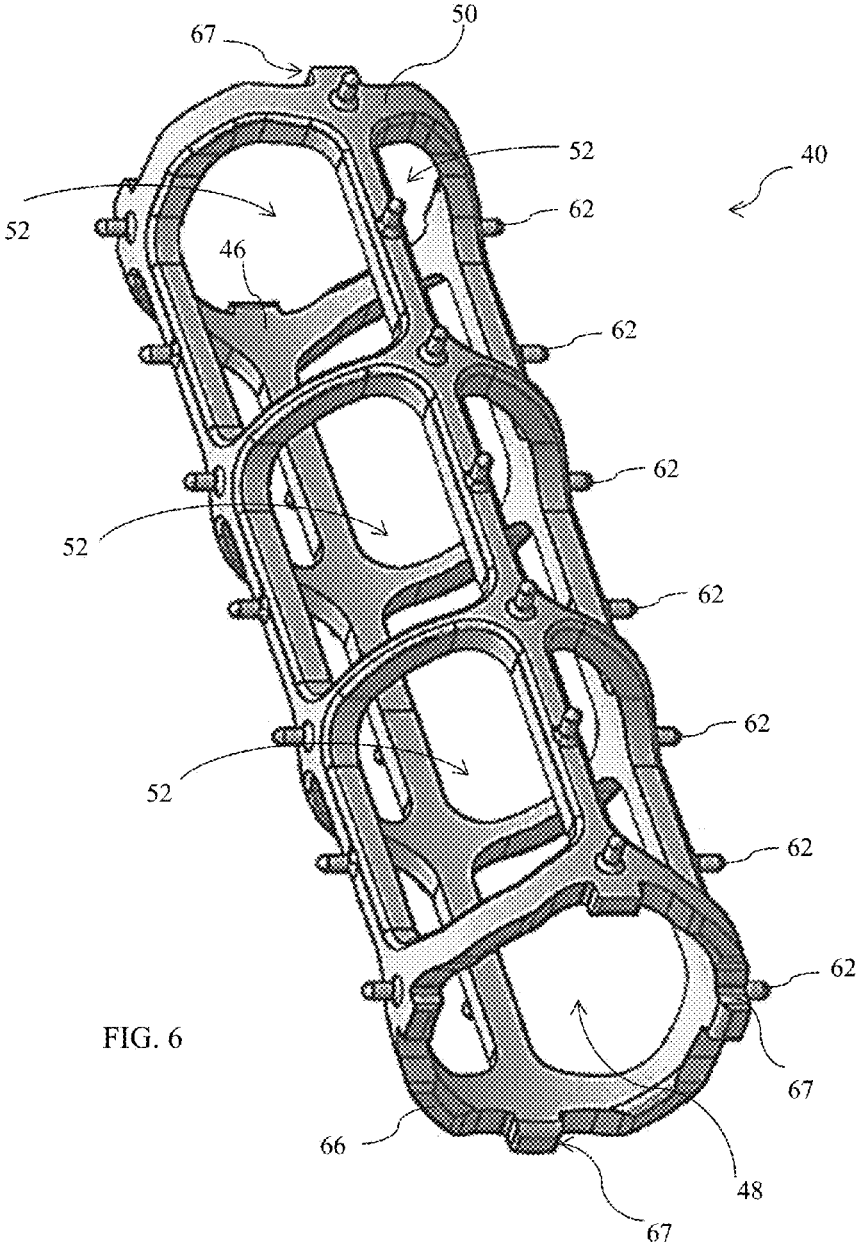
FIG. 6 is a front perspective view of a core of the noise attenuating member of FIG. 3.
Figure 7:
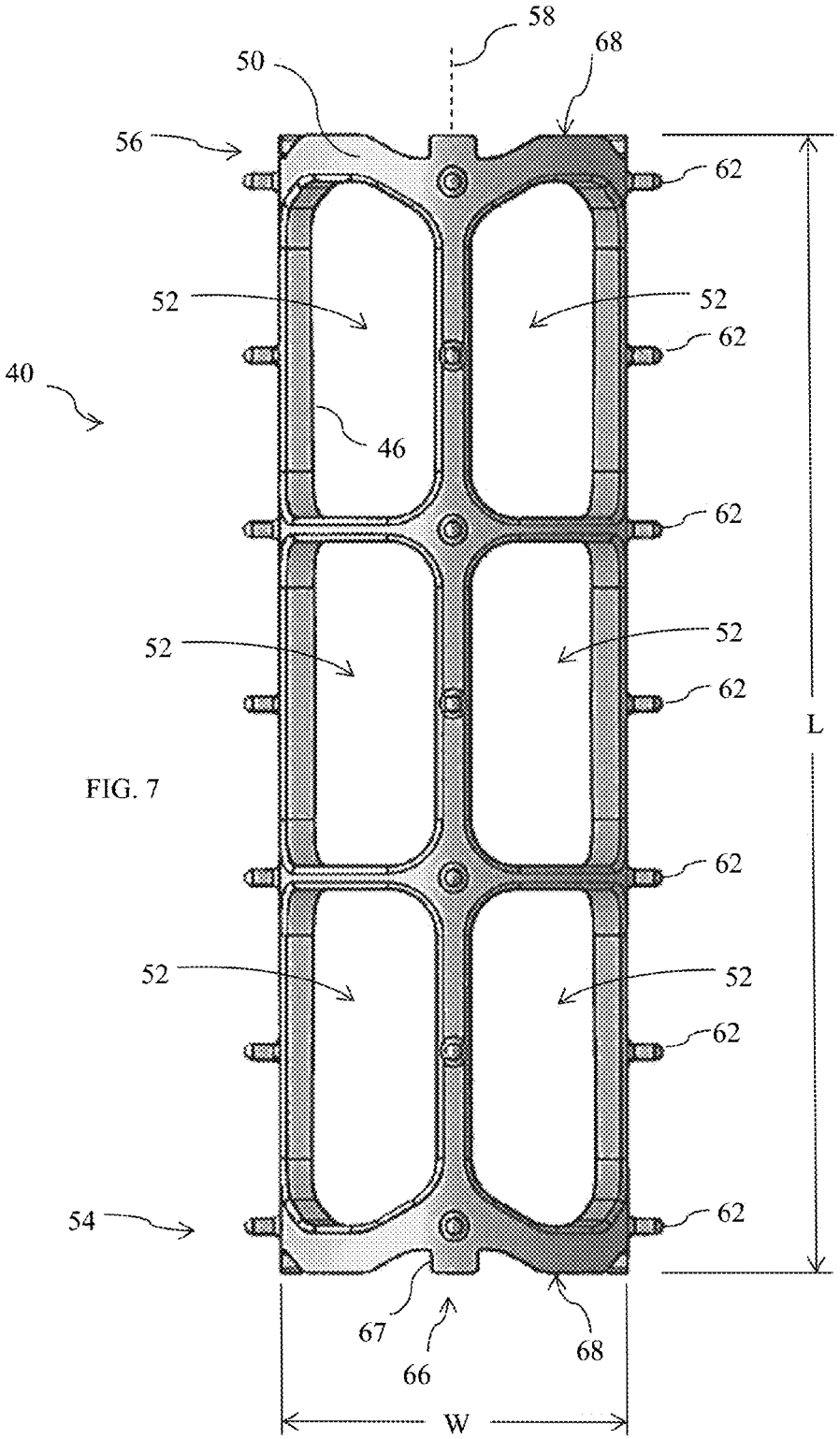
FIG. 7 is a front elevation view of the core of FIG. 6.
Figure 8:
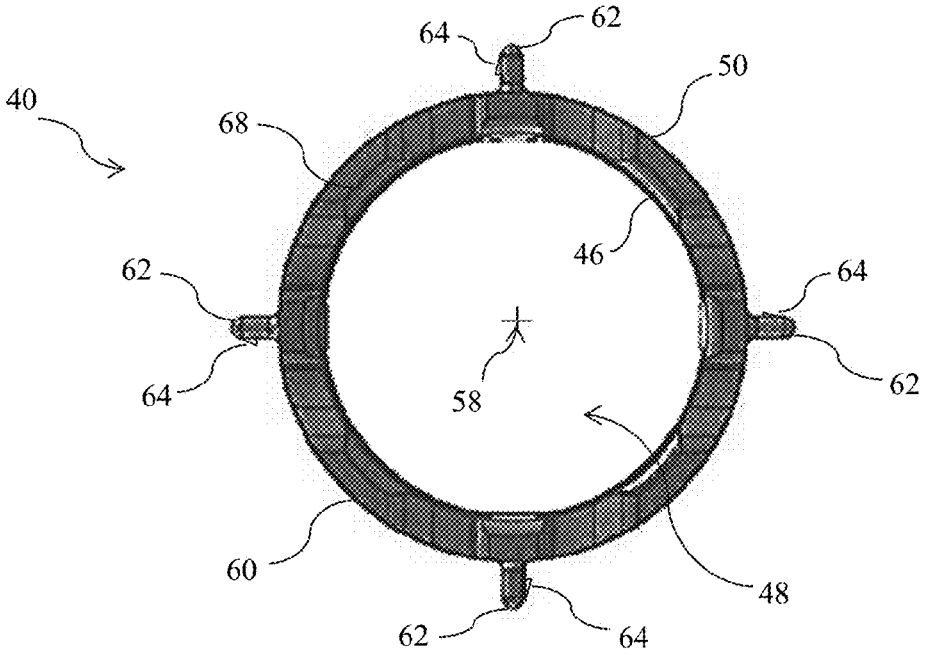
FIG. 8 is top plan view of the core of FIG. 6.

Referring now to FIGS. 6-8, the core 40 of the noise attenuating member 20 is illustrated. The interior surface 46 and the exterior surface 50 of the core 40 have a general cross-sectional shape, relative to the center axis 58 of the noise attenuating member 20, that may be any convenient shape, including, but not limited to, circular, square, rectangular, polygonal, multi-faceted, or other shape. The interior surface 46 and the exterior surface 50 may have similar cross-sectional shapes, or the cross-sectional shapes of the surfaces 46, 50 may be different. In one embodiment shown in FIGS. 6-8, the core 40, notwithstanding the plurality of radial openings 52, may be an annular cylinder, for which the cross-sectional shape of both the interior surface 46 and exterior surface 50 are generally circular. In one embodiment, the cross-sectional shapes (notwithstanding the radial openings 52) of the interior surface 46 and the exterior surface 50 may change along a length L of the core 40. A width W and the length L of the core 40 may be selected based on the configuration and dimensions of the housing 14 of the noise attenuation unit 10 into which the noise attenuating member 20 is to be incorporated.

The core 40 may be constructed of any suitable material, including, but not limited to, metal, plastic, ceramic, carbon fiber, glass, fiberglass, wood, rubber, or combinations thereof, and may have one or more surface coatings to prevent deterioration of the core 40. In one embodiment, the core 40 is constructed of a rigid material. In one embodiment, the material of the core 40 is not degraded or deteriorated by operating conditions of the fluid system into which it is installed, specifically the elevated temperatures and vibrations that occur in an engine. In one embodiment, the core material is selected to withstand elevated temperatures. In another embodiment, the core material is selected to resist corrosion from moisture and other corrosive compounds.

The radial openings 52 through the core 40 may be any convenient shape, including, but not limited to, circular, square, rectangular, polygonal, multi-faceted, or other shape. The radial openings 52 may all have the same shape and size, or one or more of the radial openings 52 may have a shape and/or size that is different from the other radial openings 52. In the embodiment shown in FIG. 6, the radial openings 52 may have the same general shape, which is generally rectangular with rounded corners. In other embodiments, the radial openings 52 may be generally circular in cross-section. The radial openings 52 may be any convenient size and may be selected to increase exposure of the fluid flow to the porous material 42 as the fluid flows through the inner cavity 48. The radial openings 52 are larger in size than the pores of the porous material 42 disposed about the core 40, but are not so large that the core 40 is deformed into the inner cavity 48 by a weight or force exerted on the core 40 by the porous material 42. In one embodiment, each of the radial openings 52 may have an area in a range of about 0.7 to about 1.5 times a cross-sectional area of the inner cavity 48. In another embodiment, each of the radial openings 52 may be in a range of about 0.9 to about 1.3 times the cross-sectional area of the inner cavity 48. In another embodiment, each of the radial openings 52 may have an area that is in a range of about 1.0 to about 1.2 times the cross-sectional area of the inner cavity 48.

The radial openings 52 may be distributed along the entire length L of the core, from the first end 54 to the second end 56 of the noise attenuating member 20, and may be distributed angularly along an outer cross-sectional circumference 60 of the core 40. In the embodiment of FIGS. 6 and 7, the radial openings 52 are distributed evenly throughout the core 40 in both the axial and angular directions. In one embodiment, the radial openings 52 may not be evenly spaced but may be positioned to manipulate the flow dynamics through the noise attenuating member 20. In the embodiment illustrated in FIG. 6, the core 40 has a total of 12 radial openings 52 arranged in three sections of four radial openings 52 that are distributed evenly about the outer circumference of the core 40. The three sections are axial sections with respect to the axial length L of the core 40. The four radial openings 52 in each section are aligned radially about the outer circumference of the core 40, and the radial openings 52 are also aligned with the radial openings 52 of an adjacent section. In one embodiment (not shown), the radial openings 52 may be offset or staggered with respect to either or both of radial openings 52 of the same section or different sections. In other embodiments, the core 40 may have more or less than three sections of radial openings 52 and may have more or less than four radial openings 52 per section.

A total void space of the exterior surface 50 of the core 40 may be defined as the sum of the cross-sectional areas of the radial openings 52, and a theoretical outer surface area of the core 40 may be defined as the surface area of the exterior surface 50 of the core 40 without the radial openings 52. In one embodiment, the total void space represented by the radial openings 52 may be in a range of about 50% to about 95% of the theoretical exterior surface area of the core 40. In another embodiment, the total void space represented by the plurality of radial openings 52 may be in a range of about 60% to about 90% of the theoretical exterior surface area of the core 40. In another embodiment, the total void space may be in a range of about 70% to about 80% of the theoretical exterior surface area of the core 40. In the embodiment illustrated in FIG. 6, the total void space is about 75% of the theoretical exterior surface area of the core 40. In one embodiment, the core 40 may be a support structure resembling a hollow cylindrical grid/framework. In another embodiment, the core 40 may be a hollow cylindrical grid made up of wall segments connected or coupled together to define the plurality of radial openings 52. The core 40 may be a cylindrical lattice of integrated wall portions defining the plurality of openings 52. In one embodiment, the core 40 may include a plurality of pieces that are coupled together or engaged to make the core 40.

Still referring to FIGS. 6-8, the core 40 may have a plurality of protrusions 62 extending radially outward from the exterior surface 50 of the core 40. Each of the protrusions 62 may include a feature 64 (or retaining feature), as shown in FIG. 8, that retains the porous material 42 against the exterior 50 of the core 40. Examples of the retaining feature 64 include, but are not limited to, barbs, notches, ribs, textured surfaces, other protruding features, or combinations thereof. In one embodiment, the feature 64 includes one or more barbs that catch on the porous material 42 coupling it to the exterior surface 50 of the core 40. The protrusions 62 may be distributed along the entire exterior 50 of the core 40, the distribution being both axial and angular. In one embodiment, the protrusions 62 may be concentrated in a specified region of the exterior surface 50 of the core 40, such as a region where the porous material 42 is first attached prior to being wound around the core 40.

As shown in FIGS. 6-8, the core 40 has end surfaces 68 facing generally in opposing axial directions and positioned at the first end 54 and second end 56 of the noise attenuating member 20. One or both of the end surfaces 68 of the core 40 may have one or more engagement features 66 for engagement of the core 40 with a machine during one or more assembly operations. In one embodiment, the engagement features 66 may include one or more shoulders 67 against which a drive surface of a drive mechanism may engage to rotate the core 40 during assembly operations. In another embodiment, the engagement features 66 may be one or more tabs, pins, or other protrusions that are received in a drive mechanism to engage the drive mechanism with the core 40 for rotation therewith during assembly operations. In one embodiment, more than one type of engagement feature 66 may be used for engagement with a drive mechanism.

Referring back to FIGS. 3-5, the porous material 42 disposed about the core 40 may have pores (not shown) with a pore size that is less than the radial openings 52 in the core 40, but large enough to not unduly restrict or interfere with fluid flow such as, for example, air flow through the system. The pores may be a network of hollow channels in a porous material 42, such as the channels propagating through a sponge material, or may also be an interconnected matrix of void spaces extending through the porous material 42, such as the void spaces between fibers of a woven fabric or between layers of a wire mesh. The porous material 42 can be made from a variety of materials including, but not limited to, metals, plastics, ceramics, glass, or combinations thereof. The porous material 42 may be a wire, a wool, a matrix of woven particles, a matrix of matted particles, a matrix of sintered particles, a woven fabric, a matted fabric, a mesh, a sponge, or combinations thereof. Porous material 42 made from metals include, but are not limited to, metal wire mesh, metal wire wool, metal wire felt, or combinations thereof. In one embodiment, the porous material 42 is a wire mesh. In another embodiment, the porous material 42 may be a woven plastic or nylon fabric. The porous character of the sound attenuating member 20 causes the noise pressure waves propagating through the fluid to attenuate by interfering with themselves. In one embodiment, the porous material 42 is not harmed (does not deteriorate) by operating temperatures of an engine based on placement of the noise attenuating member 20 in the engine system. Additionally, the porous material 42 is not harmed by the vibrations experienced during operating conditions of the engine.

Figure 9:
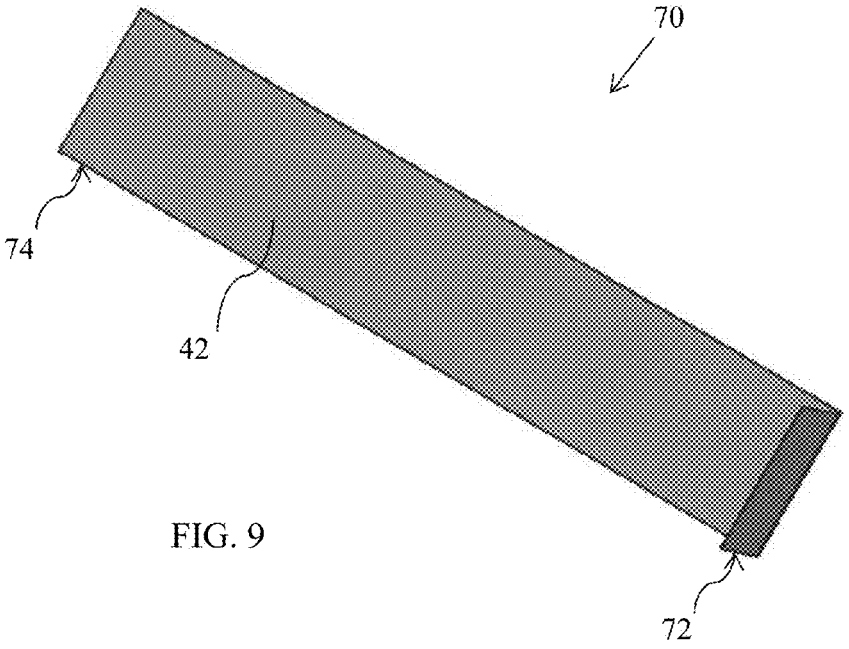
FIG. 9 is a front perspective view of a strip of porous material used to assemble one embodiment of a noise attenuating member.
Figure 10:
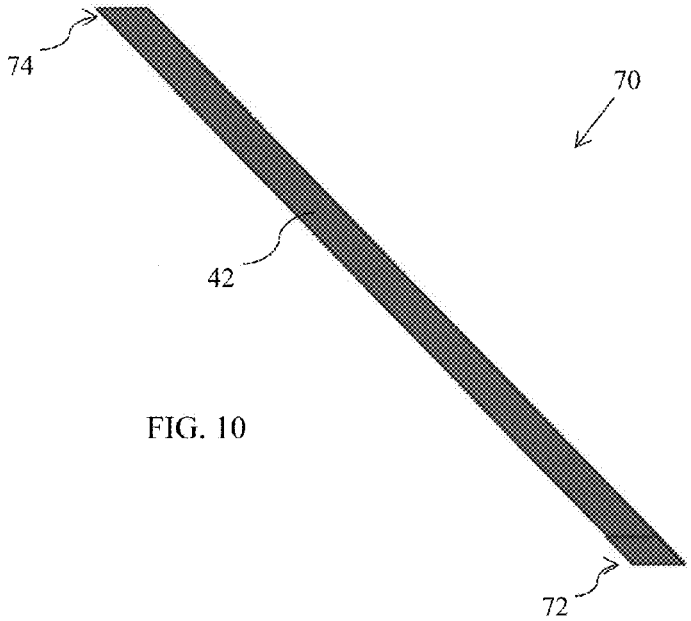
FIG. 10 is a front perspective view of the strip of porous material of FIG. 9 with the first end folder over.
Figure 11:
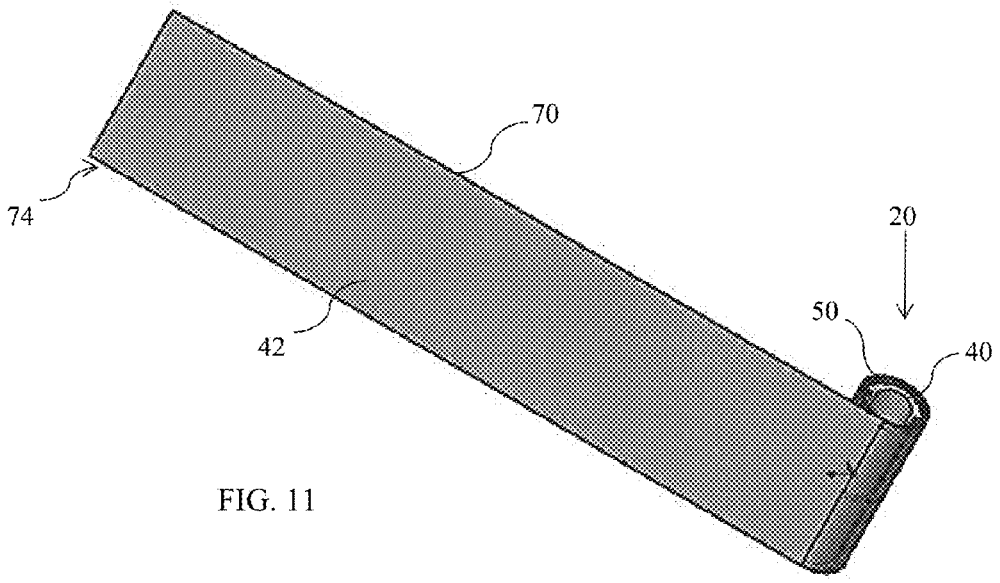
FIG. 11 is a front perspective view of the strip of porous material of FIG. 9 being wound about a core.

The porous material 42 may be formed as a plurality of layers of porous material 42 wound around the core 40. Referring now to FIGS. 9-11, the porous material 42 may be a continuous strip 70 (strip) of porous material having a first end 72 and a second end 74. The first end 72 may be coupled to the exterior 50 of the core 40, and the strip 70 may be wound around the exterior 50 of the core 40 until the porous material 42 reaches a specified thickness, which may depend upon the geometry of the noise attenuating unit 10 into which the noise attenuating member 20 is to be incorporated. In one embodiment, the first end 72 of the strip 70 may be engaged with the protrusions 62 extending from the exterior 50 of the core 40 such that the protrusions 62 extend through the strip 70 of porous material to hold the strip 70 in engagement with the core 40. In one embodiment, the first end 72 of the strip 70 may be folded over onto itself so that a portion of the strip 70 that engages with the core 40/protrusions 62 has two layers of porous material, which may act to improve or strengthen the engagement of the strip 70 with the core 40. Tension on the strip 70 during the winding process may change the density of the porous material 42 disposed about the core 40. More tension on the strip 70 results in denser layers of porous material 42, and likewise, less tension results in less dense layers of porous material 42. Following winding, the second end 74 of the strip 70 is then secured to an outermost layer 76 of porous material 42, or other structure, to keep the strip 70 from unwinding from the core 40. The second end 74 may be welded, fastened, adhered, taped or otherwise attached to the outermost layer 76 of porous material 42. In one embodiment, the second end 74 is welded to the outermost layer 76 of porous material 42.

Still referring to FIGS. 9-11, a method of making a noise attenuating member 20 includes providing a core 40 having an interior surface 46 that defines an inner hollow cavity 48 for fluid flow therethrough, providing a strip 70 of porous material 42 having a first end 72 and a second end 74, and wrapping the strip 70 of porous material 42 about the core 40 beginning from the first end 72 to form one or more layers of porous material 42 disposed about the core 40. The core 40 is provided having a plurality of radial openings 52 extending therethrough. The axial end surfaces 68 of the core 40 can have engagement features 66 to allow for engagement of the core 40 with a machine capable of rotating the core 40 during the assembly operations. In some embodiments, the method of making a noise attenuating member 20 includes the steps of engaging the core 40 with a machine capable of rotating the core 40 about an axis. In some embodiments, the center axis 58 is the center of rotation for the core 40. As shown in FIG. 10, the method may include folding over the first end 72 of the strip 70 so that the first end 72 of the strip 70 has two layers of material. The method also includes engaging the first end 72 of the porous material 42 with the exterior surface 50 of the core 40. In one embodiment, the first end 72 of the strip 70 may be engaged with the protrusions 62, and the retaining features 64 thereon, securing the first end 72 of the strip 70 to the exterior surface 50 of the core 40. In other embodiments, the first end 72 of the strip 70 may be curled over, crimped tight to, or crimp welded to the exterior 50 of the core 40.

Referring to FIG. 11, the core 40 may be rotated to wind the strip 70 of porous material 42 about the core 40 to form one or more layers of porous material 42 disposed about the core 40. In some embodiments, the method may further include applying tension to the strip 70 and adjusting the tension to achieve a specified density of the porous material 42 wound around the core 20. Upon winding the strip 70 about the core 40, the second end 74 of the strip 70 may be secured to an outermost layer 76 of porous material 42, such as through welding, sintering, fastening, or adhering, for example. In some embodiments, the core 40 may have multiple pieces such that assembling the core 40 happens prior to engaging the first end 72 of the strip 70 with the exterior surface 50.

Referring back to FIG. 2, the assembled noise attenuating member 20 may be installed in a noise attenuation unit 10, which may be incorporated into a fluid flow system requiring sound attenuation. In operation, fluid flows into the noise attenuation unit 10 through the first port 22 and through the noise attenuating member 20. Some of the fluid flows directly into the porous material 42, where the flow through the plurality of pores disrupts the turbulent flow eddies entering the noise attenuation unit 10. In the inner hollow cavity 48 of the core 40, the turbulent nature of the flow also causes fluid to flow radially through the radial openings 52 in the core 40 and into the porous material 42, which further dissipates the turbulent eddies that give rise to sound vibrations. The fluid flow exits from the porous material 42 and out of the noise attenuation unit 10 through the second port 24.

The noise attenuating member 20 of the present application may produce repeatable attenuation with minimal interference with fluid flow through the system. The core 40 provides a support for the porous material 42 to keep the porous material 42 in place within the noise attenuating unit 10 into which it is installed. The hollow internal cavity 48 of the core 40 may provide a straight flow path through the noise attenuating member 20, which may reduce the pressure drop across the noise attenuating member 20 compared to existing noise attenuating devices. The core 40 provides support for the porous material 42 to keep the porous material 42 from being drawn into the flow path and interfering with the fluid flow through the noise attenuating unit 10. Providing a means of engagement of the strip 70 of porous material 42 with the core 40 may also reduce the welding that must be performed on a noise attenuating member 20 and thus maintain fluid flow through the noise attenuating member.

Having described the invention in detail and by reference to specific embodiments thereof, it will be apparent that numerous modifications and variations are possible without departing from the spirit of the invention as defined by the following claims.

What is claimed is:

1. A noise attenuating member comprising:

a core defining a hollow cavity for fluid flow therethrough, the core being a hollow cylindrical grid defining a plurality of radial openings; and a porous material disposed about an exterior of the core;

wherein fluid flow through the hollow cavity and the radial openings passes through the porous material.

2. The noise attenuating member of claim 1, wherein the porous material comprises a plurality of layers of the porous material disposed about the core.

3. The noise attenuating member of claim 2, wherein the plurality of layers of porous material comprises a continuous strip thereof wound about the exterior of the core.

4. The noise attenuating member of claim 3, wherein the continuous strip of porous material has a first end folded over onto itself for engagement with the exterior of the core.

5. The noise attenuating member of claim 1, wherein each of the plurality of radial openings is larger than a pore size of the porous material.

6. The noise attenuating member of claim 1 wherein the plurality of radial openings define a void space of at least 50% of a theoretical exterior surface area of the core.

7. The noise attenuating member of claim 1 wherein each of the plurality of radial openings has an area of at least 0.7 times a cross-sectional area of the hollow cavity.

8. The noise attenuating member of claim 1 wherein the core further comprises a plurality of protrusions extending outward from the exterior of the core.

9. The noise attenuating member of claim 8, wherein each protrusion includes one or more features that retain the porous material against the exterior of the core.

10. The noise attenuating member of claim 1, wherein the porous material comprises one or more of metal, carbon fiber, ceramic, plastic, and glass.

11. The noise attenuating member of claim 10, wherein the porous material is a wire, a wool, a matrix of woven particles, a matrix of matted particles, a matrix of sintered particles, a woven fabric, a matted fabric, a mesh, a sponge, or combinations thereof.

12. The noise attenuating member of claim 10, wherein the porous material comprises metal and is one or more of a metal wire mesh, a metal wire wool, and a metal wire felt.

13. A noise attenuating unit connectable to become part of a fluid flow path comprising:

a housing defining an internal cavity and having a first port and a second port, each connectable to a fluid flow path and in fluid communication with one another through the internal cavity; and an attenuating member seated in the internal cavity of the housing within the flow of the fluid communication between the first port and the second port and the fluid communication between the first port and the second port includes fluid flow through the attenuating member, the attenuating member comprising:

a core defining a hollow cavity for fluid flow therethrough, the core being a hollow cylindrical grid defining a plurality of radial openings; and a porous material disposed about an exterior of the core;

wherein fluid flow through the hollow cavity and the radial openings passes through the porous material.

14. The noise attenuating unit of claim 13, wherein the housing is a two-part housing having a first housing portion and a second housing portion.

15. The noise attenuating unit of claim 13, wherein the fluid flow path from the first port to the second port travels axially through the attenuating member.

16. The noise attenuating unit of claim 13, wherein the fluid flow path from the first port to the second port travels through the attenuating member from the hollow cavity radially outward through the porous material.

17. The noise attenuating unit of claim 13, wherein the housing is integrated with a Venturi apparatus for generating vacuum.

18. A method for making a noise attenuating member comprising:

providing a core defining a hollow cavity for fluid flow therethrough and defining a plurality of radial openings, wherein the core has a plurality of protrusions extending outward from the exterior thereof;

providing a strip of porous material, the strip having a first end and a second end;

engaging the porous material with the protrusions to retain the porous material against the core; and wrapping the strip of porous material about the core beginning from the first end to form one or more layers of porous material thereabout.

19. A method for making a noise attenuating member comprising:

providing a core defining a hollow cavity for fluid flow therethrough and defining a plurality of radial openings;

providing a strip of porous material, the strip having a first end and a second end;

folding the first end of the strip of porous material over onto itself; and wrapping the strip of porous material about the core beginning from the first end to form one or more layers of porous material thereabout.

20. The method of claim 18, further comprising adjusting a tension applied to the strip of porous material during wrapping to change the density of the one or more layers of porous material wrapped about the core.

21. A noise attenuating member comprising:

a core defining a hollow cavity for fluid flow therethrough and defining a plurality of radial openings, the core including a plurality of protrusions extending outward from the exterior of the core; and a porous material disposed about an exterior of the core;

wherein fluid flow through the hollow cavity and the radial openings passes through the porous material.

* * * * *